United States Patent [19]

Parlebas et al.

[11] 4,352,279

[45] Oct. 5, 1982

[54] DEVICE FOR MOUNTING CLOSURES ON DOOR PANELS

[76] Inventors: Gérard G. Parlebas; Solange Lebars-Parlebas, both of 11 ave. Junot, 14 Hameau des Artistes, 75018 Paris, France

[21] Appl. No.: 196,796

[22] PCT Filed: Sep. 18, 1979

[86] PCT No.: PCT/FR79/00082

§ 371 Date: May 19, 1980

§ 102(e) Date: May 19, 1980

[87] PCT Pub. No.: WO80/00589

PCT Pub. Date: Apr. 3, 1980

[30] Foreign Application Priority Data

Sep. 19, 1978 [FR] France ..... 78 26780

[51] Int. Cl.[3] ..... E05B 9/08

[52] U.S. Cl. ..... 70/451; 70/443; 292/DIG. 53

[58] Field of Search ..... 70/451, 448, 443, 466, 70/91, 95, 101; 292/DIG. 53, DIG. 46, 337

[56] References Cited

U.S. PATENT DOCUMENTS

| | | | |
|---|---|---|---|
| 3,848,908 | 11/1974 | Rich | 292/DIG. 46 X |
| 4,126,022 | 11/1978 | Marco | 292/DIG. 53 X |
| 4,139,999 | 2/1979 | Allenbawgh | 70/448 X |

FOREIGN PATENT DOCUMENTS

| | | | |
|---|---|---|---|
| 1282044 | 12/1961 | France | 292/337 |
| 2351234 | 12/1977 | France | 70/451 |
| 2373656 | 7/1978 | France . | |

*Primary Examiner*—William E. Lyddane

*Attorney, Agent, or Firm*—Young & Thompson

[57] ABSTRACT

A bracket for mounting a closure such as a lock on a door which is difficult to pierce, such as a glass door, comprises a pair of platens on opposite sides of each edge of the door. The platens of one pair are secured to the platens of the other pair, on opposite sides of the door, by tightening elements which can be straps whose ends are interconnected by screw-threaded bolts, or long screw-threaded pins in the case of a narrow door. Covering bands are slidable in slideways on the platens to cover the platens and tightening elements, and stops are detachably secureable to the edges of the doors to retain these covering bands.

11 Claims, 6 Drawing Figures

DEVICE FOR MOUNTING CLOSURES ON DOOR PANELS

The present invention relates generally to a device forming a covering band which can serve as a bracket supporting a lock for doors or flat panels, particularly of glass.

French Pat. No. 76-14.582 published under No. 2,351,234 discloses a device which will permit the fixation of a lock on a glass door without necessitating cutting the door. This device includes a belt of metal or similar material completely surrounding the leaf of the door at lock level, with this belt having at least one break so that it can be tightened around the door leaf, so that it will be held in place by friction. Said belt then has means for mounting of the lock.

The advantages which would result from deletion of the operation of making one or more cuts in such a glass door are obvious; it must also be added that certain safety glasses are very difficult to work and therefore lend themselves poorly to the realization of such cuts.

French Certificate of Addition No. 76-37.267, published under No. 2,373,656, to the aforementioned patent, also describes means which permit the connection of an electric lock which can be mounted on this belt when the door is in any position and which elastically compensates the differences resulting from the angular deflection of the door during its opening.

In practice, such devices must be adapted to doors or panels having very different dimensions. With known means, this necessitates either storage of finished products of various dimensions, with the investment which that entails, or the fabrication or adaptation of the belt for each panel as a function of the dimensions of the door or panel in each case, which very obviously increases the cost of using said belt with doors or panels.

Besides, in order to assure perfect immobilisation of the belt on the door, a certain tightening force will be called for, particularly near the break provided in the belt just for this tightening. In order that these forces be absorbed by the belt, it must have a certain mechanical resistance, thus a certain thickness. Thus, in the case wherein the doors or panels are relatively large or wide, this can result in a relatively heavy belt of increased thickness, with a resulting increased rigidity, which is not favorable where the belt encompasses the edges of the door or panel, points at which on the contrary should be found a better faculty of adaptation of the material to the edge of the glass.

The object of the invention is to provide a solution to the problem which is posed and to allow realization of a device from a small number of standardized pieces, the device adaptable to a very large range of dimensions of doors or glass panels, while also furnishing the necessary properties of lightness and mechanical resistance in the parts which are subjected to the tightening forces.

The invention is manifested in a device forming a covering band which can serve as a bracket supporting a lock for doors or flat panels, particularly of glass, characterized in that it includes two pairs of rigid platens, the platens of each pair being linked by a flexible strap bent in a U-shape, affixed by its edges on each of the platens, said platens also having hooking means, traction clamping elements, adaptable between the platens of the two aforementioned pairs, means to regulate the length of these elements, such that when the platen pairs are fitted on the opposite sides of a door or panel in such a position that the flexible strap uniting the two platens of one pair clamps one of the edges of the door or panel, the elements which are adapted between the platens can be controlled to tighten these flexible straps on these edges, thus affixing the device on the door or panel, and profilings forming slippers, provided on the edges of the platens, and a covering band provided with lateral profilings adapted to the profilings forming slippers on the platens and which can be engaged on said profilings. The traction clamping elements can be elements forming braces or the like.

According to one possible embodiment, the platens present at least one and preferably two rows or series of hooking means such as clips or holes, and a brace is provided for each row of hooking means which can come into contact with said means through the holes or the clips respectively, and including length adjustment means for the tightening of the device around the door or panel.

One advantageous realization consists of providing a two-part brace for each row or series of hooking means on the platens, and control means, constituted for example of a bolt or a threaded pin, are provided between these two parts of the brace to tighten the device around the door or panel. The two parts of the brace are advantageously constituted of small strips which can slide one within the other, which simultaneously assures the maintenance of these two parts in a particular alignment relationship.

Of course it is possible to provide one single clip or one single hole for each row or series on each platen, and a plurality of holes or clips on the braces, or inversely a plurality of clips or holes in each row or series of platens and one single hole or one single clip on the parts of the brace, but a better adaptation capacity and a better distribution of the forces as well as a better alignment between the platens are obtained by providing, as indicated, rows of clips or holes on both the platens and the braces.

It is obvious that it is thus possible, by juxtaposition of pairs of platens and by adapting the position of the braces, to cover very different widths of doors or panels. In such cases, the adaptation can call for the replacement of the braces, but it then has to do with low cost pieces. The profile forming a covering band is simply cut to the proper length from great lengths of profiled pieces which can be kept in storage.

In the case of narrow panels, using narrower platens, it is also possible to clamp the device around the edges of the panel by means of threaded pins which extend between the hooking elements, or tabs provided opposite one another on the platens. The use of threaded pins here permits easy and low cost adaptation to the panel width.

The fixation of the flexible straps bent in U-shape to the platens can take place in any desired manner, for example by welding, rivetting, etc. . . . Openings can be provided in the platens, through which are engaged the tabs or like parts of the flexible straps, from the inside, with these tabs being folded back against the outside surface of the platen for their fixation. Thus a hooking of the flexible straps is realized which is such that they can efficiently resist the traction forces exerted during tightening.

According to another particular feature, the platens have hooking means for the elastic elements which hold a movable cable for the connection of an electric lock, as described in Certificate of Addition No. 76-37.267.

In the case of a door, one of the platens or pairs of platens carries a lock and/or door handle bracket support. A solution which appears to be sensible consists of attaching ties or analogous supports to this platen or these platens, by welding or the like. They are provided with threaded studs in the foundation or casing of the lock or handle.

According to one advantageous feature, the platens have tabs or like elements at their edges for fixation of the flexible straps in U-shape. A rod forming a stop extends along the top of each platen or of the covering band and the end of the platen or band comes to abut against said rods. These stops or rods thus close the band at its ends, furnishing a satisfactory esthetic appearance for the assembly of the device. They also assure the longitudinal positioning of the covering bands.

The top and bottom profiles of the platens can be constituted of wings which are folded outward at an angle, and the covering band advantageously presents on its edges a right-angle element and a dovetail which can be engaged by sliding onto these wings of the platens. This provides a simple placement of the covering band after it has been cut to length, as well as a good transverse retention of the door or panel.

Of course, the space within each covering band can hold all of the elements necessary for the control of a lock, whether it has to do with a simple electric control by cable, an opto-electronic or a magnetic identification control, or other. The transfers from one surface to another of the door or panel are effected in this case within the device, between the glass and the flexible straps.

If desired, a material which prevents sliding can also be inserted between the platens and/or the flexible straps and the glass.

The following description relative to the nonlimiting attached drawing will further the understanding of the invention.

Figure 1:
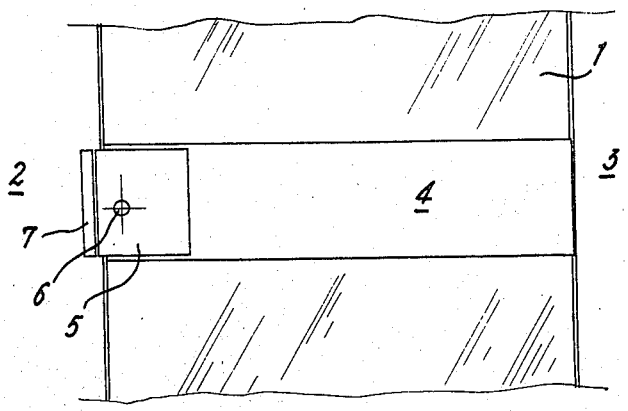
FIG. 1 is a diagrammatic representation in partial elevation of a door with the device according to the invention.

In FIG. 1, a glass door 1 is mounted between two panels 2, 3 and on it is fitted a device according to the invention. Its covering band 4 includes a handle 5 with a lock insert area 6, and a latch 7 is affixed to panel 2.

Figure 4:
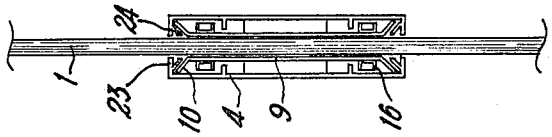
FIG. 4 is a cross section view along line IV—IV of FIG. 2.
Figure 2:
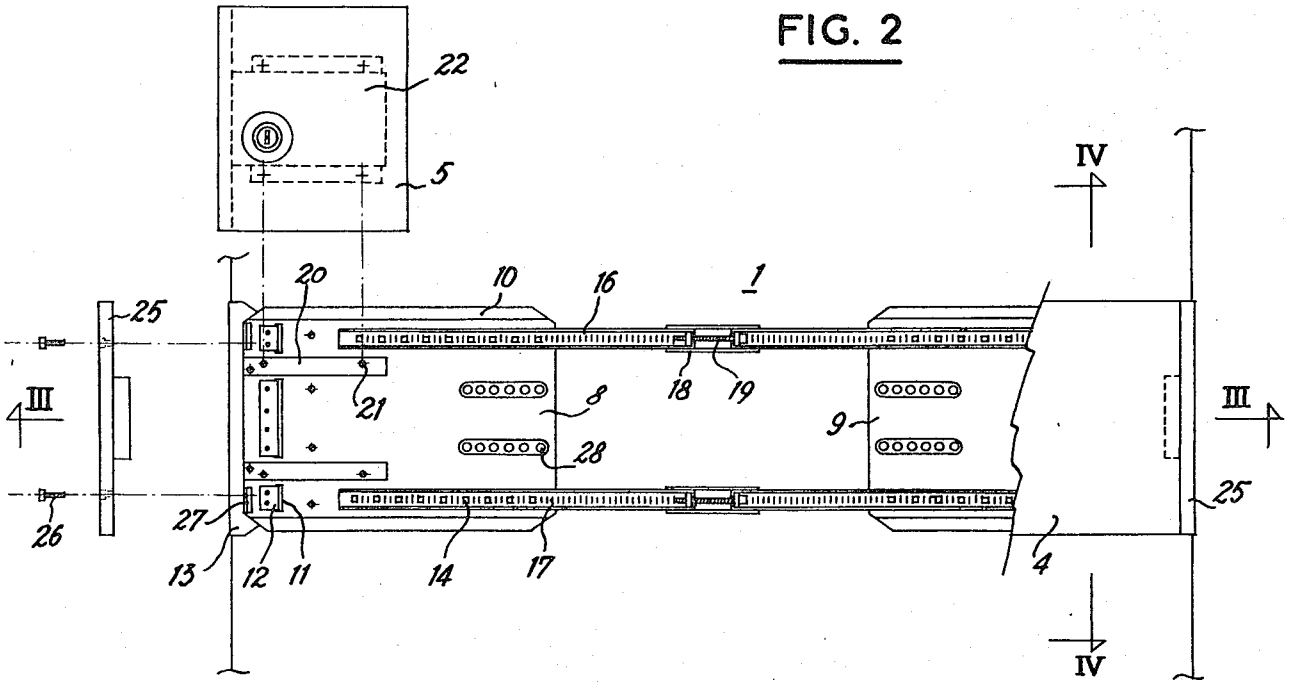
FIG. 2 is a larger scale elevation with cutout corresponding to one embodiment.
Figure 3:
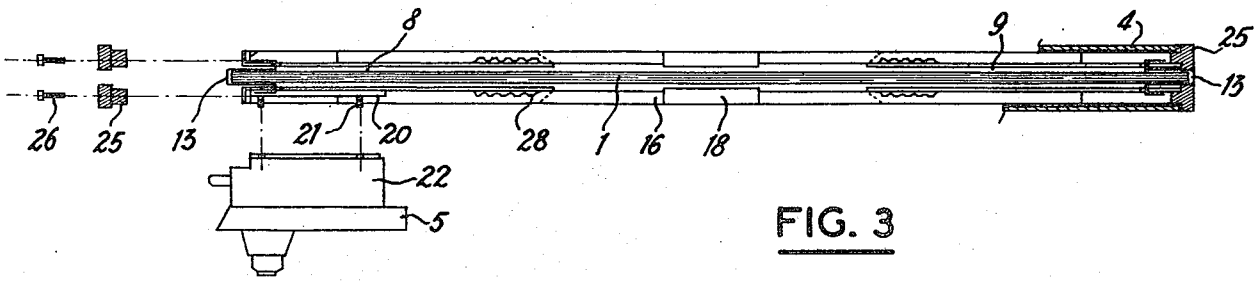
FIG. 3 is a cross section view along line III—III of FIG. 2.

In FIGS. 2 to 4, the same elements as in FIG. 1 have been designated by the same reference numbers.

In these drawings it is clear that the device includes two pairs of platens 8, 9. The platens of each pair have a generally rectangular shape. They are of a rigid material, for example of metal of sufficient thickness to furnish rigidity and resistance as necessary to support the effects of tightening for locking. They are provided on their top and bottom edges (viewing the platens in mounted position) with profilings, each constituted of a wing 10 which is slanted outward, of which the role will be discussed hereinafter.

Near one vertical edge, the platens have openings 11 through which are engaged from the inside (also in mounted position) the tabs 12 of a flexible strap 13 bent in U-shape, which strap is intended to encompass one edge of glass door 1 as is shown in FIGS. 2 and 3. Tabs 12 realize the hooking of the flexible strap on the platens and are affixed on them by welding or rivetting or the like.

Thus, near each vertical edge of the glass door, there is provided an arrangement of two platens 8 or 9 on each side of the door and linked together by a flexible strap 13 bent in U-shape, which clamps the vertical edge of glass door 1.

According to this embodiment, each platen 8, 9 has two rows of clips 14, here arranged near the top and bottom edges of the platens, these rows or series being parallel to said edges.

Two braces are provided for the assembly of the device around door 1, one on each side of the door, each constituted of two small strips 16 which have a U-shape profile to confer an improved rigidity to them, and they are provided in their bases with holes 17 in a series corresponding to that of the clips on the platens. According to the embodiment shown, one strip carries a guide 18 in which the other strip can slide freely. A short threaded pin 19 associated with a nut is provided between the ends of the small strips for tightening.

It is clear that it is possible, with the features described to this point, to realize the adaptation of a device according to the invention to doors of very different widths, with the aid of a very small number of standardized pieces. In fact, for this adaptation, it suffices to mount the small strips on the platens by hooking them in position, relative to the width of the door, with the final tightening being realized by means of the threaded pins 19. The rigidity of the platens and their resistance furnish a strong assembly, assuring a good fixation, and the flexible straps realize a good adaptation around the edges of the door.

Even for the doors of extraordinary width, it suffices to use other small strips, for example longer ones, without the necessity of using other platens.

The juxtaposition of the holes of the small strips with series of clips or holes in the platens also assures the alignment of the platens relative to each other.

According to the embodiment shown in FIG. 2, ties 20 are affixed for example by welding on one of the platens 8 of one pair, particularly on the platen which is toward the outside surface of the door, and each of the ties carries two threaded studs 21. These studs serve for the assembly of a lock on the platen, which is indicated diagrammatically in dotted line at 22 in FIG. 2. The handle 5 is itself affixed to this lock.

The means of mounting covering band 4 on the assemly by tightening on the door is more clear in FIG. 4.

In this drawing, each covering band 4 includes a profiling near its top and bottom edges, including a tab 23 perpendicular to the principal plane of the covering band and extending essentially to the glass of the door in mounted position, and a wing 24 slanted toward the inside. The covering bands 4 can be engaged on the aforementioned assemblies, particularly on platens 8, 9, by sliding wings 24 on one and the other sides of wings 10 of the platens, which serve as slippers.

The mounting of the covering bands is thus simplified to the maximum.

The longitudinal positioning of covering bands 4 is assured at each end of these covering bands by two rods which form stops or abutments 25, which cover the ends of the cavities formed between bands 4 and platens 8, 9, while being partically encased in said cavities, which assures an esthetic finish on the sides of the door. These rods are affixed here by means of screw 26 which cooperates with the funnel-shaped holes (not shown) in the tabs 27 on platens 8, 9.

FIG. 2 shows, in each of the platens, two series of holes 28 which can serve for the hooking of flexible drawback elements for return of a movable cable in the case of use of an electric lock.

Figure 5:
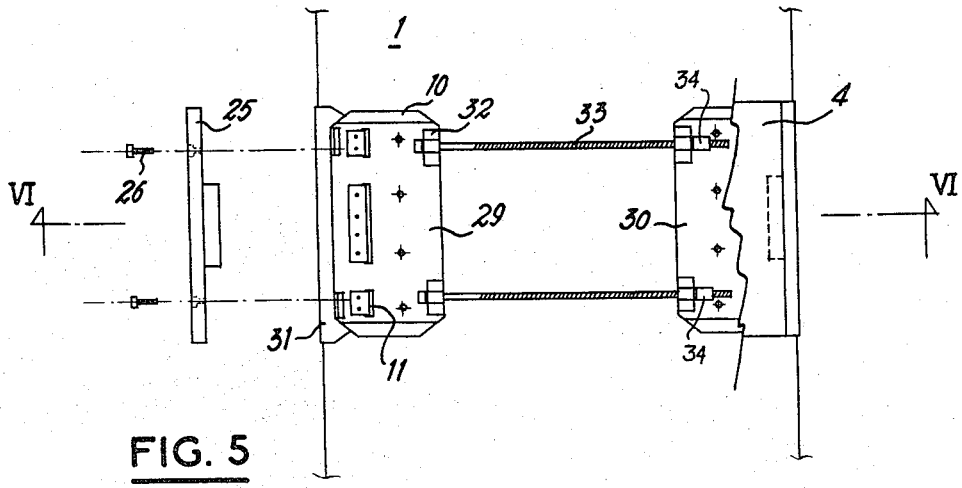
FIG. 5 is an analogous view of FIG. 2 but of another variation.
Figure 6:
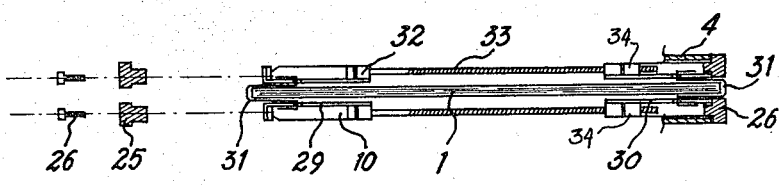
FIG. 6 is a cross section view along line VI—VI of FIG. 5.

The variation shown in FIGS. 5 and 6 is intended to allow mounting on the panels of very small width. In this case, two platens 29, 30 of narrower width are provided, linked as in the preceding embodiment by flexible straps 31 which encompass the edges of the glass panel and are linked with the platens in the same manner as in the preceding.

In this embodiment, the platens have tabs 32 on their opposite edges, and the tightening of the device around the panel is obtained by means of threaded pins 33 passing through these tabs and nuts 34.

Covering bands 4 are mounted and positioned longitudinally in the same manner as in the preceding embodiment, and the same references have been used in FIGS. 5 and 6 to designate the corresponding elements.

Thus it is obvious that the invention allows a universal adaptation of covering bands to doors or panels of glass of very different dimensions, with a small number of standardized elements, in such a manner as to simplify the mounting and limit the cost of manufacture and the storage investment. Only the covering bands, which can be manufactured in very long profiled elements, then must be cut into suitable lengths.

Modifications can be applied to the embodiments described, in the range of the same technology, without exceeding the limitations of the invention.

We claim:

1. A bracket for mounting a closure on a door, comprising two pairs of rigid platens, a flexible strap bent in U shape and securing together the platens of each pair, traction tightening elements extending from the platens of one pair to the platens of the other pair, means for adjusting the length of the traction tightening elements to draw the pairs of platens toward each other to clamp them securely to a door, means defining slideways on the edges of the platens, and covering bands having portions complementary to said slideways to slide in said slideways to cover the platens and tightening elements.

2. A bracket as claimed in claim 1, said tightening elements comprising vertically spaced horizontally extending braces.

3. A bracket as claimed in claim 1, each platen having a horizontal series of fastening means on its upper and lower edges for coaction with complementary fastening means on said tightening elements.

4. A bracket as claimed in claim 1, said tightening elements being in two parts interconnected by a threaded member to draw said two parts toward each other.

5. A bracket as claimed in claim 4, said two parts of each tightening element having adjacent ends encased in sliding relation to each other.

6. A bracket as claimed in claim 1, for use with narrow doors, in which said tightening elements comprise threaded pins that bridge the gap between and are secured to the platens of the respective said pairs of platens.

7. A bracket as claimed in claim 1, said U-shaped straps having outstanding tabs on their ends which extend through openings in said platens.

8. A bracket as claimed in claim 1, said platens having hooking means for the elastic elements of a movable cable for connection to an electric lock.

9. A bracket as claimed in claim 1, at least one of said platens having means for securing a lock and a handle thereon.

10. A bracket as claimed in claim 1, said slideways comprising outwardly inclined wings on said platens.

11. A bracket as claimed in claim 1, and means detachably secured to the ends of the platens at the edges of the doors to retain said covering bands on said platens.

* * * * *